US009218015B2

(12) United States Patent
Marinca

(10) Patent No.: US 9,218,015 B2
(45) Date of Patent: Dec. 22, 2015

(54) METHOD AND CIRCUIT FOR LOW POWER VOLTAGE REFERENCE AND BIAS CURRENT GENERATOR

(71) Applicant: Analog Devices, Inc., Norwood, MA (US)

(72) Inventor: Stefan Marinca, Limerick (IE)

(73) Assignee: ANALOG DEVICES, INC., Norwood, MA (US)

( * ) Notice: Subject to any disclaimer, the term of this patent is extended or adjusted under 35 U.S.C. 154(b) by 233 days.

(21) Appl. No.: 13/648,639

(22) Filed: Oct. 10, 2012

(65) Prior Publication Data

US 2013/0038317 A1 Feb. 14, 2013

Related U.S. Application Data

(63) Continuation-in-part of application No. 13/544,609, filed on Jul. 9, 2012, now Pat. No. 8,531,169, which is a continuation of application No. 12/415,606, filed on Mar. 31, 2009, now Pat. No. 8,228,052.

(51) Int. Cl.
*G05F 3/30* (2006.01)

(52) U.S. Cl.
CPC ..... *G05F 3/30* (2013.01)

(58) Field of Classification Search
CPC ..... G05F 3/30
USPC ..... 323/312–317, 908, 311; 327/539, 542, 327/513
See application file for complete search history.

(56) References Cited

U.S. PATENT DOCUMENTS

| | | | | |
|---|---|---|---|---|
| 4,618,816 | A * | 10/1986 | Monticelli | 323/316 |
| 5,448,158 | A * | 9/1995 | Ryat | 323/315 |
| 5,469,111 | A | 11/1995 | Chiu | |
| 6,002,243 | A | 12/1999 | Marshall | |
| 6,181,121 | B1 | 1/2001 | Kirkland et al. | |
| 7,710,096 | B2 * | 5/2010 | Kotchkine et al. | 323/313 |
| 7,863,882 | B2 | 1/2011 | Harvey | |
| 2002/0050811 | A1 * | 5/2002 | Serratoni | 323/311 |
| 2004/0108887 | A1 | 6/2004 | Marsh et al. | |

(Continued)

FOREIGN PATENT DOCUMENTS

| | | |
|---|---|---|
| EP | 0629938 | 6/1994 |
| JP | 63163518 | 7/1988 |

(Continued)

OTHER PUBLICATIONS

Office Action issued in JP Application No. 2012-503480, dated Dec. 24, 2013, 8 pages (with EN translation).

(Continued)

*Primary Examiner* — Harry Behm
(74) *Attorney, Agent, or Firm* — Kenyon & Kenyon LLP

(57) ABSTRACT

Circuits for generating a PTAT voltage as a base-emitter voltage difference between a pair of bipolar transistors. The circuits may form unit cells in a cascading voltage reference circuit that increases the PTAT voltage with each subsequent stage. The bipolar transistors are controlled using a biasing arrangement that includes an MOS transistor connected to a current mirror that provides the base current for the bipolar transistors. A voltage reference is formed by combining a PTAT voltage and a CTAT voltage at the last stage. The voltage reference may be obtained from the voltage at an emitter of one of the bipolar transistors in the last stage.

24 Claims, 11 Drawing Sheets

(56) References Cited

U.S. PATENT DOCUMENTS

| | | | | |
|---|---|---|---|---|
| 2005/0285666 | A1 | 12/2005 | Garlapati et al. | |
| 2006/0103455 | A1 | 5/2006 | Zhang et al. | |
| 2008/0265860 | A1 | 10/2008 | Dempsey et al. | |
| 2009/0039949 | A1 * | 2/2009 | Pietrobon | 327/539 |
| 2013/0200878 | A1 * | 8/2013 | Kalb et al. | 323/313 |

FOREIGN PATENT DOCUMENTS

| | | |
|---|---|---|
| JP | 7-141046 | 6/1995 |
| JP | 2000-112550 | 4/2000 |
| JP | 2003-256056 | 9/2003 |
| JP | 2006-221241 | 8/2006 |

OTHER PUBLICATIONS

PCT International Search Report and Written Opinion for PCT/US2010/027977 mailed on May 18, 2010, 12 pages.

Wing-Shan Tam et al., "High-Performance Resistorless Sub-1V Bandgap Reference Circuit Based on Piecewise Compensation Technique", XP031229799, 2007 IEEE Conference on Electron devices and Solid-State Circuits, Taiwan, Dec. 2007, pp. 373-376.

Ahmet Tekin et al., "A Bias Circuit Based on Resistorless Bandgap Reference in 0.35-[mu] m SOI CMOS", XP010867412, Midwest Symposium on Circuits and Systems, Egypt, Dec. 2003, pp. 149-152.

EP Communication with a Supplementary European Search Report issued in EP Application No. 10759208.1 dated Aug. 4, 2015, 8 pages.

* cited by examiner

METHOD AND CIRCUIT FOR LOW POWER VOLTAGE REFERENCE AND BIAS CURRENT GENERATOR

CROSS-REFERENCE TO RELATED APPLICATIONS

This application is a continuation-in-part of U.S. patent application Ser. No. 13/544,609, filed Jul. 9, 2012, which is a continuation of Ser. No. 12/415,606 filed Mar. 31, 2009, now U.S. Pat. No. 8,228,052, the contents of which are incorporated herein by reference in their entireties.

COPYRIGHT AND LEGAL NOTICES

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates generally to voltage references and in particular to voltage references implemented using bandgap circuitry. The present invention more particularly relates to a circuit and method which provides a Voltage Proportional to Absolute Temperature (PTAT) voltage which can be scaled and tuned.

BACKGROUND INFORMATION

A conventional bandgap voltage reference circuit is based on the addition of two voltage components having opposite and balanced temperature slopes.

FIG. 1 illustrates a symbolic representation of a conventional bandgap reference. It consists of a current source, 110, a resistor, 120, and a diode, 130. It will be understood that the diode represents the base-emitter junction of a bipolar transistor. The voltage drop across the diode has a negative temperature coefficient, TC, of about −2.2 mV/° C. and is usually denoted as a Complementary to Absolute Temperature (CTAT) voltage, since its output value decreases with increasing temperature. This voltage has a typical negative temperature coefficient according to equation 1 below:

$$V_{be}(T) = V_{G0}\left(1-\frac{T}{T_0}\right) - V_{be}(T_0)*\frac{T}{T_0} - \sigma*\frac{KT}{q}*\ln\left(\frac{T}{T_0}\right) + \frac{KT}{q}*\ln\left(\frac{Ic(T)}{Ic(T_0)}\right) \quad \text{(Eq. 1)}$$

Here, $V_{G0}$ is the extrapolated base-emitter voltage at zero absolute temperature, of the order of 1.2V; T is actual temperature; $T_0$ is a reference temperature, which may be room temperature (i.e. T=300K); $V_{be}(T_0)$ is the base-emitter voltage at $T_0$, which may be of the order of 0.7V; σ is a constant related to the saturation current temperature exponent, which is process dependent and may be in the range of 3 to 5 for a CMOS process; K is the Boltzmann's constant, q is the electron charge, $I_c(T)$ and $I_c(T_0)$ are corresponding collector currents at actual temperatures T and $T_0$, respectively.

The current source 110 in FIG. 1 is desirably a Proportional to Absolute Temperature (PTAT) source, such that the voltage drop across resistor 120 is PTAT voltage. As absolute temperature increases, the voltage drop across resistor 120 increases as well. The PTAT current is generated by reflecting across a resistor a voltage difference ($\Delta V_{be}$) of two forward-biased base-emitter junctions of bipolar transistors operating at different current densities. The difference in collector current density may be established from two similar transistors, i.e. Q1 and Q2 (not shown), where Q1 is of unity emitter area and Q2 is n times unity emitter area. The resulting $\Delta V_{be}$, which has a positive temperature coefficient, is provided in equation 2 below:

$$\Delta V_{be} = V_{be}(Q_1) - V_{be}(Q_2) = \frac{KT}{q}*\ln(n) \quad \text{(Eq. 2)}$$

In some applications, for example low power applications, the resistor 120 may be large and even dominate the silicon die area, thereby increasing cost. Therefore, it is desirable to have PTAT voltage circuits which are resistorless. PTAT voltages generated using active devices may be sensitive to process variations, via offsets, mismatches, and threshold voltages. Further, active devices used in PTAT voltage cells may contribute to the total noise of the resulting PTAT voltage. One goal of an embodiment of the present invention is to provide a resistorless PTAT cell operable at low power with little sensitivity to process variations and having low noise.

FIG. 2 illustrates the operation of the circuit of FIG. 1. By combining the CTAT voltage, V_CTAT of diode 130 with the PTAT voltage, V_PTAT, from the voltage drop across resistor 120, it is possible to provide a relatively constant output voltage Vref over a wide temperature range (i.e. −50° C. to 125° C.). This base-emitter voltage difference, at room temperature, may be of the order of 50 mV to 100 mV, for n from 8 to 50.

To balance the voltage components of the negative temperature coefficient from equation 1 and the positive temperature coefficient of equation 2, it is desirable to have the capability of fine-tuning the PTAT component to improve the immunity to process variations. Accordingly, in another embodiment of the present invention, a goal is to provide a fine-tune capability of the PTAT component.

In yet another embodiment of the present invention, it is a goal to multiply the ΔVbe component of transistors which are operated at different current densities to provide a higher reference voltage which is insensitive to temperature variations.

BRIEF DESCRIPTION OF THE DRAWINGS

The invention is illustrated in the figures of the accompanying drawings, which are meant to be exemplary and not limiting, and in which like references are intended to refer to like or corresponding parts.

DETAILED DESCRIPTION

A system and method are provided for a PTAT cell with no resistors which can operate at low power, has less sensitivity to process variation, occupies less silicon area, and has low noise. In another aspect of the invention, a system and method are provided to scale up the reference voltage and current. In yet another aspect of the present invention, a system and method are provided for a PTAT component to be fine-tuned.

Figure 1:
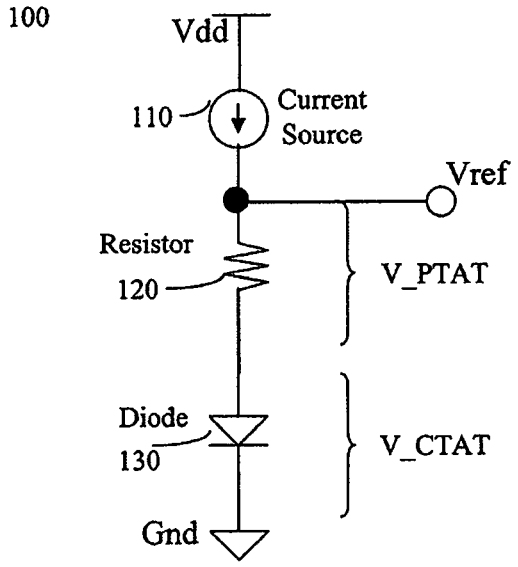
Fig. 1 Prior Art
FIG. 1 shows a known bandgap voltage reference circuit.
Figure 2:
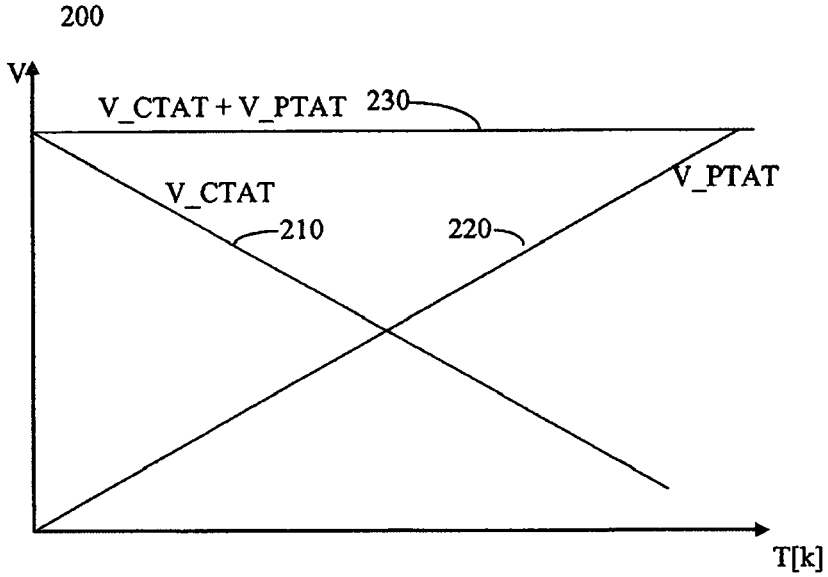
Fig. 2 Prior Art
FIG. 2 is a graph that illustrates how PTAT and CTAT voltages generated through the circuit of FIG. 1 may be combined to provide a reference voltage.
Figure 3A:
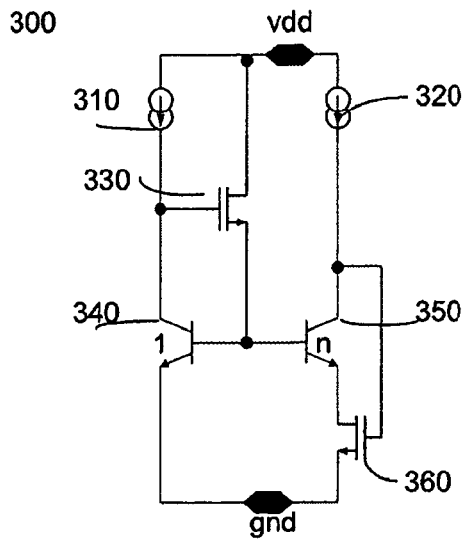
FIG. 3*a* shows a resistorless PTAT unit cell in accordance with an embodiment of the present invention.

The resistorless PTAT cell of FIG. 3*a* is an embodiment of an aspect of the present invention. Circuit 300 includes a first set of circuit elements arranged to provide a complimentary to absolute temperature (CTAT) voltage. For example, the first set of circuit elements may comprise transistors 330 and 340, which are supplied by current source 310. Transistor 330 may be, for example, an NMOS. A second set of circuit elements are arranged to provide a proportional to absolute temperature (PTAT) voltage or current. For example, the second set of circuit elements may comprise at least transistor 350 and active element 360. Transistor 350 is supplied by current source 320. In one embodiment, active device 360 may be an NMOS. Transistors 340 and 350 may be bipolar transistors.

Transistor 350 of the second set of circuit elements is configured such that it has an emitter area n times larger than transistor 340 of the first set of circuit elements. Thus, if the current sources 310 and 320 provide the same current, and the current through the gate of transistor 360 can be neglected, transistor 340 operates at n times the current density of transistor 350. In one embodiment, transistor 330 of the first set of circuit elements, supplies the base currents of transistors 340 and 350. Further, transistor 330 may also control the base-collector voltage of transistor 340 to minimize its Early effect. Transistor 360 also has several roles. First, at the emitter of transistor 350, it generates, via feedback, the base-emitter voltage difference in accordance with the collector current density of the ratio of transistors 340 and 350. Second, it limits the collector voltage of transistor 350, thereby reducing the Early effect of transistor 350. The aspect ratio (W/L) of transistors 330 and 360 can be chosen such that, at first order, the base-collector voltages of transistor 340 and transistor 350 track each other to minimize the Early Effect.

The PTAT voltage at the drain of transistor 360 of FIG. 3*a* is provided in equation 1 below:

$$V_{PTAT} = \frac{kT}{q}\ln\left(n * \frac{I_1}{I_2}\right) \quad \text{(Eq. 1)}$$

Thus, when currents I1 (310) and I2 (320) have similar temperature dependency, the resulting voltage is purely PTAT. For example, if the two currents I1 (310) and I2 (320) are constant and they track each other, the voltage at the drain of transistor 360 is PTAT.

Figure 3B:
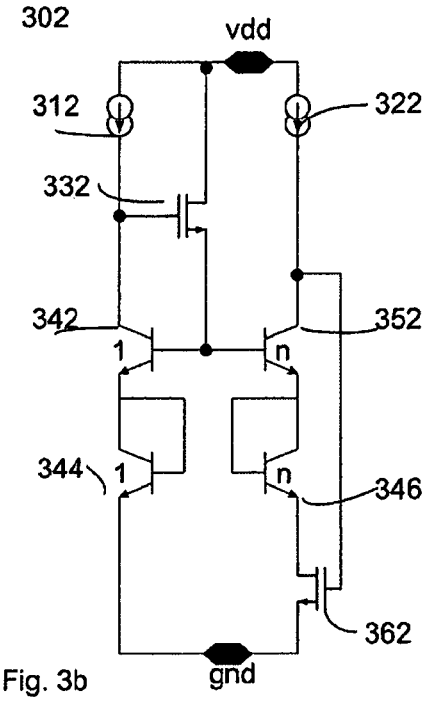
FIG. 3*b* shows a resistorless PTAT unit cell with a stack of additional transistors in accordance with an embodiment of the present invention.

For a larger PTAT voltage, a stack configuration can be used. For example, FIG. 3*b* illustrates an embodiment of a resistorless voltage reference with a stack configuration. With the additional stack transistors 344 and 346 the base-emitter voltage difference, ΔVbe, is provided in equation 1b below.

$$\Delta V_{be} = V_{PTAT} = 2 * \frac{kT}{q}\ln\left(n * \frac{I_1}{I_2}\right) \quad \text{(Eq. 1b)}$$

Figure 4:
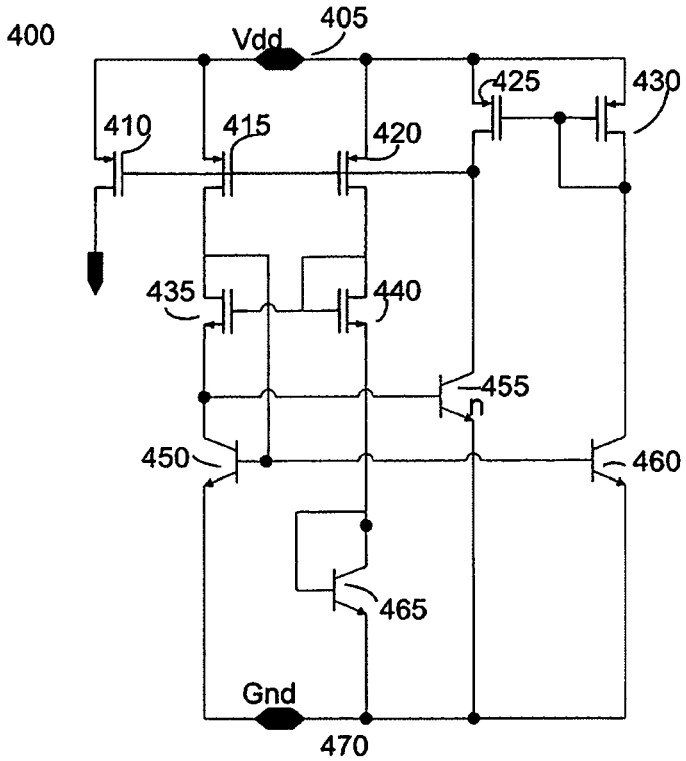
FIG. 4 shows an embodiment of a resistorless bias generator.

The two bias currents 310 and 320 of FIG. 3*a*, or 312 and 322 of FIG. 3*b*, can also be generated from a resistorless bias generator. FIG. 4 illustrates an exemplary embodiment of a resistorless bias generator wherein the base-emitter voltage difference of two bipolar transistors 450 and 455 is reflected across a transistor 435. In one embodiment, bipolar transistor 455 has n times the emitter area as bipolar transistor 450, and transistor 435 is an NMOS operated in the linear region. The bias gate voltage of transistor 435 is supplied by two diode connected transistors, transistor 440 and transistor 465. In one embodiment transistor 440 is an NMOS and transistor 465 is a bipolar transistor. Both transistors 440 and 465 are biased with the same current as transistor 435. Accordingly, transistors 435 and 440 track each other and transistor 435 is kept in the linear region.

In one embodiment, a first amplifier stage may be provided by bipolar transistors 455 and 460 and PMOSs 425 and 430. The gates of PMOSs 410, 415, and 420 are driven by the drain of transistor 425, representing the output of the first stage. A second stage amplifier stage is provided by PMOS 415, which supplies a current to transistor 435, which reflects the base-emitter difference of transistors 450 and 455.

Figure 5:
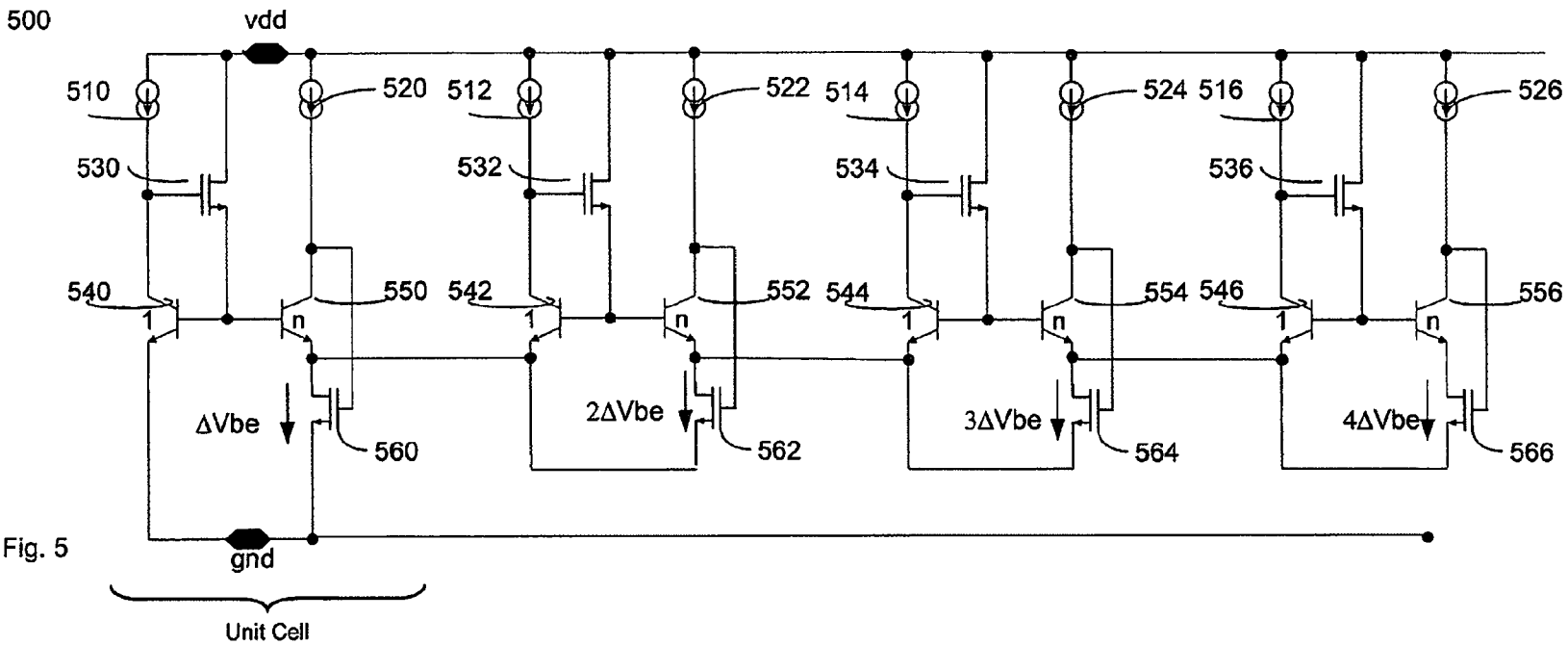
FIG. 5 shows an embodiment of a voltage cascading circuit.

FIG. 5 shows a voltage cascading circuit 500 in accordance with an embodiment of the present invention. For example, if a voltage larger than 100 mV at room temperature is desired, the unit cell 300 of FIG. 3*a* or FIG. 3*b* can be cascaded as illustrated in the example of FIG. 5. Accordingly, in this example, the output voltage of the circuit is four times the corresponding base-emitter voltage difference of transistor 550 to transistor 540. In this regard, the voltage cascading circuit 500 can be further extended by including additional unit cells similar to circuit 300 or 302. The averaging effect of the compound base-emitter voltage difference of circuit 500 advantageously provides additional consistency and is even less subject to the influence from the respective MOSFETs.

Figure 3C:
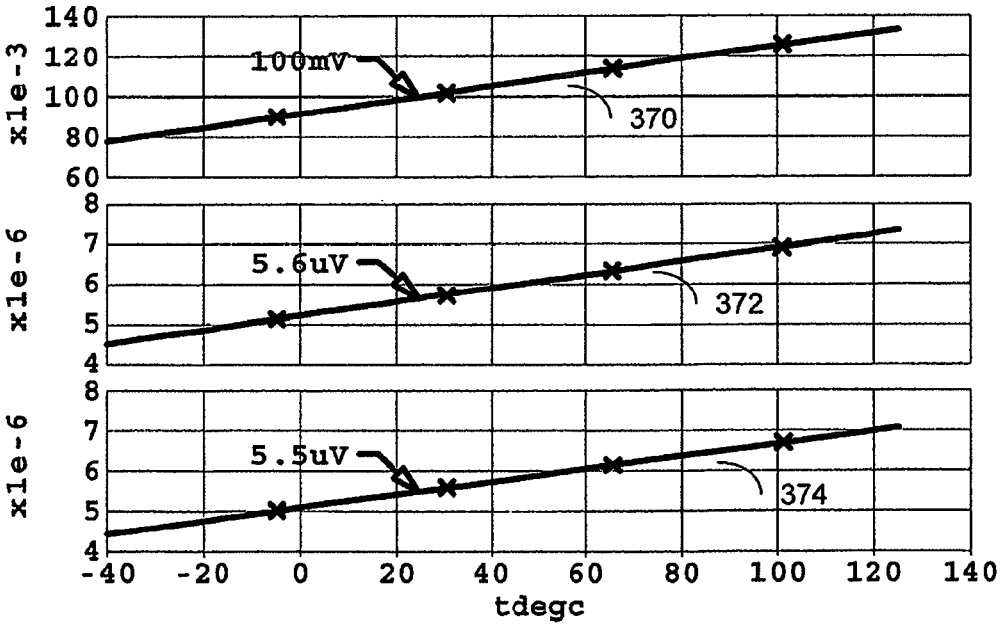
FIG. 3*c* shows PTAT voltage output vs. temperature in accordance with an embodiment of the present invention.

Advantageously, the circuits 300, 302, and 500, of FIGS. 3*a*, 3*b*, and 5, respectively, are affected very little by the offset voltages and noise introduced by any MOSFET, for example NMOSs 330 and 360. FIG. 3*c* provides simulation results of the PTAT voltage sensitivity to the offset voltage of NMOS transistors 330 and 360 in accordance with circuit 300. The parameters used in simulations include: I1=I2=10 μA, and n=48. Curve 370 represents the PTAT voltage output vs. temperature, for zero offset voltage of NMOSs 330 and 360. Curve 372 represents the difference of two PTAT voltages in accordance with circuit 300, the first PTAT voltage having a configuration where NMOS 330 has no offset voltage and the second PTAT voltage has a configuration where NMOS 330 has a 10 mV offset. Similarly, curve 374 represents the difference of two PTAT voltages, the first PTAT voltage having a configuration where NMOS 360 has no offset voltage and the second PTAT voltage has a configuration where NMOS 360 has a 10 mV offset. As evidenced by these curves, a large 10 mV offset for NMOSs 330 and 360 of FIG. 3*a* may have a less than 0.006% effect on the output.

Figure 3D:
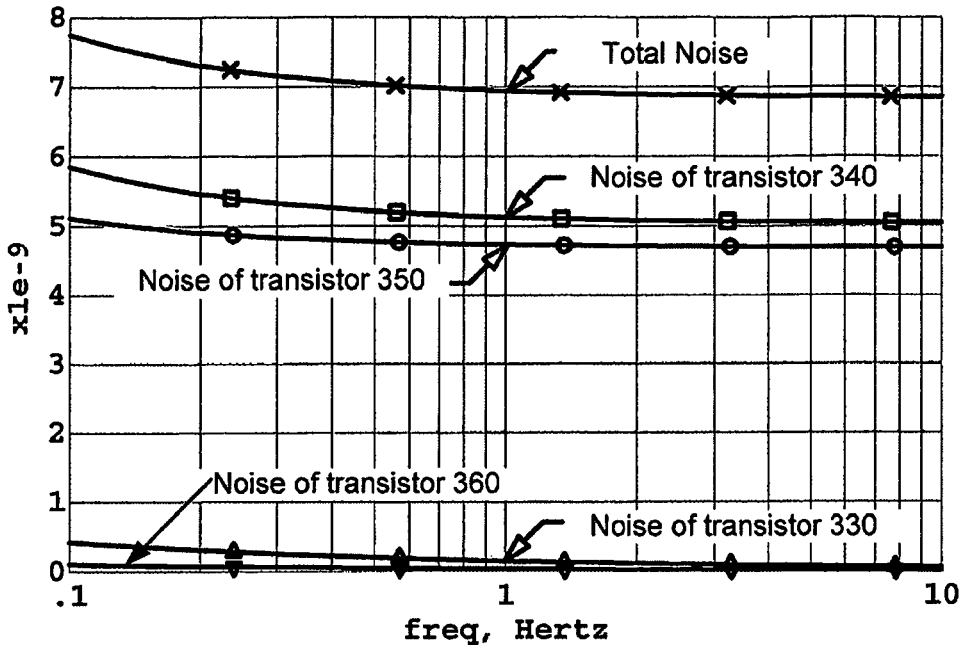
FIG. 3*d* shows simulation results of the noise contribution of different components of a voltage reference circuit in accordance with an embodiment of the present invention.

FIG. 3*d* shows simulation results of the spectral noise density and its components in 0.1 Hz to 10 Hz band for circuit 300 with the same aforementioned simulation parameters. As illustrated, noise contributions of transistors 330 and 360 are negligible compared to transistors 340 and 350.

As FIGS. 3*c* and 3*d* illustrate, the Δ base-emitter voltage across transistor 360 of the unit cell circuit 300 is very consistent and is subject to very little influence from transistors 330 and 360. An additional benefit of the configuration of circuit 300 includes its simplicity of design. Further, circuit configuration 300 consumes little power and is, thus, compatible with low power applications. Still further, circuit 300 occupies less silicon die area as compared to a conventional bandgap reference circuit which is configured with a resistor. As provided in the foregoing discussion, a resistor may even dominate the silicon die area, especially in low power applications. In this regard, the resistorless configuration of 300 saves silicon area. Further, transistors 330 and 350 may share wells and thus can be placed very close to one another, further reducing silicon area.

Figure 6:
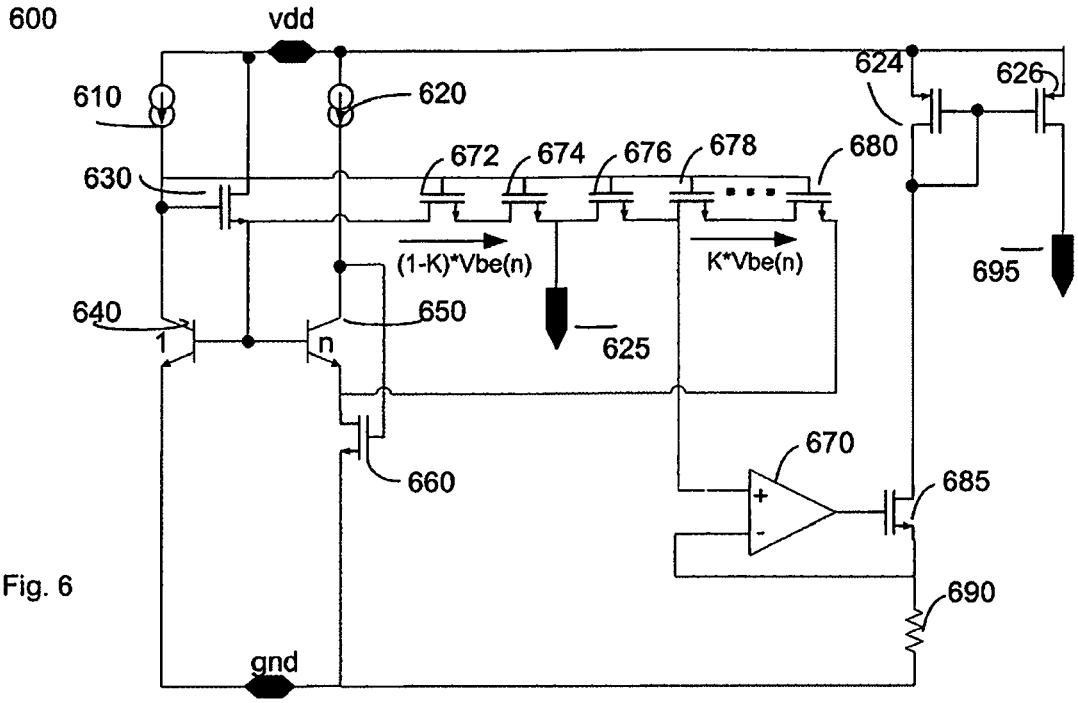
FIG. 6 shows another embodiment of the present invention in which a reference voltage is generated by adding a PTAT voltage to a base-emitter voltage fraction.

FIG. 6 illustrates another embodiment of the present invention. Circuit 600 includes a first set of circuit elements arranged to provide a complimentary to absolute temperature (CTAT) voltage or current. For example, the first set of circuit elements may comprise transistors 630 and 640, which is supplied by current source 610. Transistor 630 may be, for example, an NMOS.

A second set of circuit elements are arranged to provide a proportional to absolute temperature (PTAT) voltage or current. For example, the second set of circuit elements may comprise at least transistor 650 and of active element 660. Transistor 650 is supplied by current source 620. In one embodiment, active device 660 may be an NMOS transistor. Transistors 640 and 650 may be bipolar transistors or MOS transistors operating at different drain current densities. The configuration of circuit components 610, 620, 630, 640, 650, and 660 of FIG. 6 is substantially similar to the configuration of unit cell circuit 300 of FIG. 3*a*. Therefore, many of the features described in the context of circuit 300 also apply here.

In the exemplary embodiment of FIG. 6, transistor 630 of the first set of circuit elements, supplies the base currents of transistors 640 and 650, controls the base-collector voltage of transistor 640 to minimize its Early effect, and it also supplies the bias current into a third set of circuit elements.

In the exemplary embodiment of FIG. 6, a third set of circuit elements may comprise a plurality of resistances. For example, FIG. 6 illustrates resistances 672, 674, 676, 678, and 680. In one embodiment, the resistances 672 to 680 may be NMOSs operated in the linear (or triode) region. The number of resistances depends on the resolution of the desired base-emitter division. The third set of circuit elements divide the CTAT voltage output by the series of resistances 672 to 680, such that the output voltage at node 625 is temperature independent. Thus, the CTAT component can be further calibrated, advantageously offering a more stable output. For example, different fractions of the base-emitter voltage of transistor 650 can be added to the base-emitter voltage difference to compensate for the temperature dependency, thereby generating a reference voltage output 625 which is more temperature independent and less sensitive to process variations.

In one embodiment, the string of NMOSs (i.e., 672, 674, 676, 678, and 680) may have different gate to source voltages. Further, these NMOSs may be subject to the body effect. In this regard, the base-emitter voltage of transistor 556 may be unevenly distributed across these string of NMOSs. The voltage drop across the string of NMOSs can be balanced by scaling their respective aspect ratio (W/L).

The fourth set of circuit elements are arranged to provide a temperature independent current output 695. In one embodiment, the fourth set of circuit elements may comprise amplifier 670, transistors 624, 626, and 685, resistance 690, and output 695. For example, a combination of a PTAT voltage and a fraction of base-emitter voltage of transistor 660 is applied to the non-inverting terminal of amplifier 670. The negative terminal is connected to resistance 690 which may be a resistor (or an NMOS operated in the linear region.) Since there is a virtual zero voltage difference between the positive and negative inputs of the amplifier 670, substantially the same voltage as in the positive terminal of amplifier 370 is forced on the negative terminal. Accordingly, the voltage at the non-inverting input of the amplifier 670 is seen across resistance 690, thereby creating a current proportional to this voltage divided by the magnitude of resistance 690. The voltage at the non-inverting terminal of amplifier 670 is configured to have a specific temperature variation to compensate for the temperature coefficient of resistance 690. Thus, the tapping node (an emitter of transistors 672 to 680) that provides a temperature coefficient opposite to that of resistance 690 is chosen as the input to the non-inverting terminal of amplifier 670. In the exemplary embodiment of FIG. 6, the source of transistor 676 is used as this input. In one embodiment, this input voltage may be low, for example in the order of 200 mV as compared to traditional approaches relying on the typical bandgap voltage of about 1.2V. Advantageously, using a low input voltage saves power and allows using a smaller resistance 690, thereby further reducing chip area.

The output of amplifier 670 drives the gate of transistor 685, which may be an NMOS. Since amplifier 670 provides nearly no current at the gate of transistor 685, the current from the drain to source of transistor 685 is substantially the same as the current through resistance 690. Transistors 624 and 626 are configured as current mirrors reflecting this current at output 695. Thus, a constant current is provided at output 695, which is independent of temperature variations.

Figure 7:
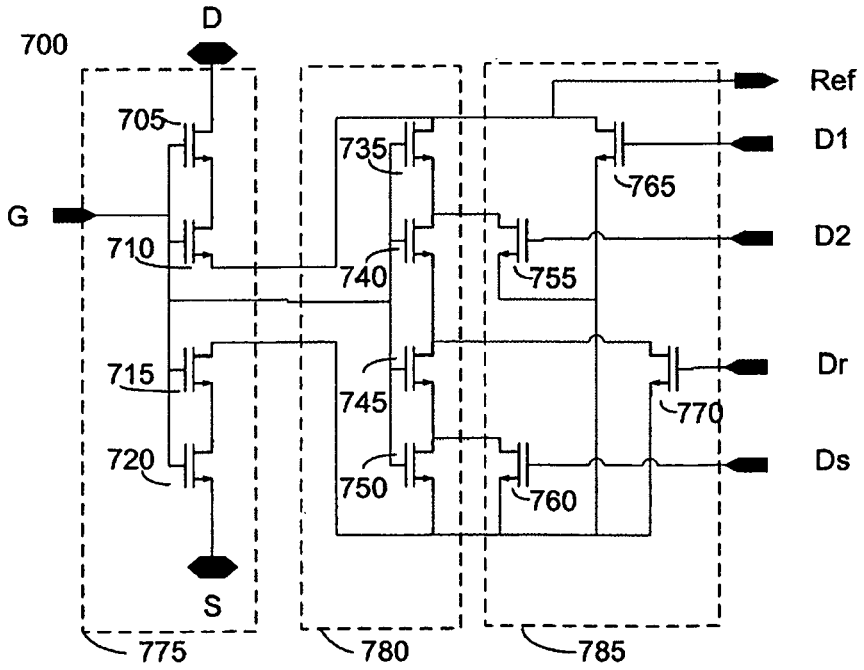
FIG. 7 shows a base-emitter digital voltage divider in accordance with an embodiment of the present invention.

In one embodiment the reference voltage at the output 625 can be digitally trimmed by selectively shorting the series of resistances. In this regard, FIG. 7 provides an embodiment of a digitally controlled base-emitter voltage. Circuit 700 of FIG. 7 may replace the base-emitter divider of resistances 672, 674, 676, 678 and 680 of FIG. 6. In another embodiment, the output may be tapped at a corresponding node between the source of NMOS transistor 750 and the drain of NMOS transistor 735. The voltage from nodes D and S is distributed across two strings: a coarse string and a fine string. In one embodiment, coarse string 775 may comprise transistors 705, 710, 715, and 720. The fine string 780 may comprise transistors 735, 740, 745, and 750. In one embodiment, the transistors of the coarse string 775 and fine string 780 are NMOS. Each drain of the NMOS transistors from fine string 780 can be shorted to the source of NMOS 750, via a digital interface consisting of NMOS transistors, 765 and 760, and an input interface, D1 to Ds. Thus, the user can determine the exact ratio. The reference voltage value at node Ref corresponds to the PTAT voltage at the node S plus the base-emitter fraction between nodes S and Ref, depending on the input code, D1 to Ds.

Figure 8:
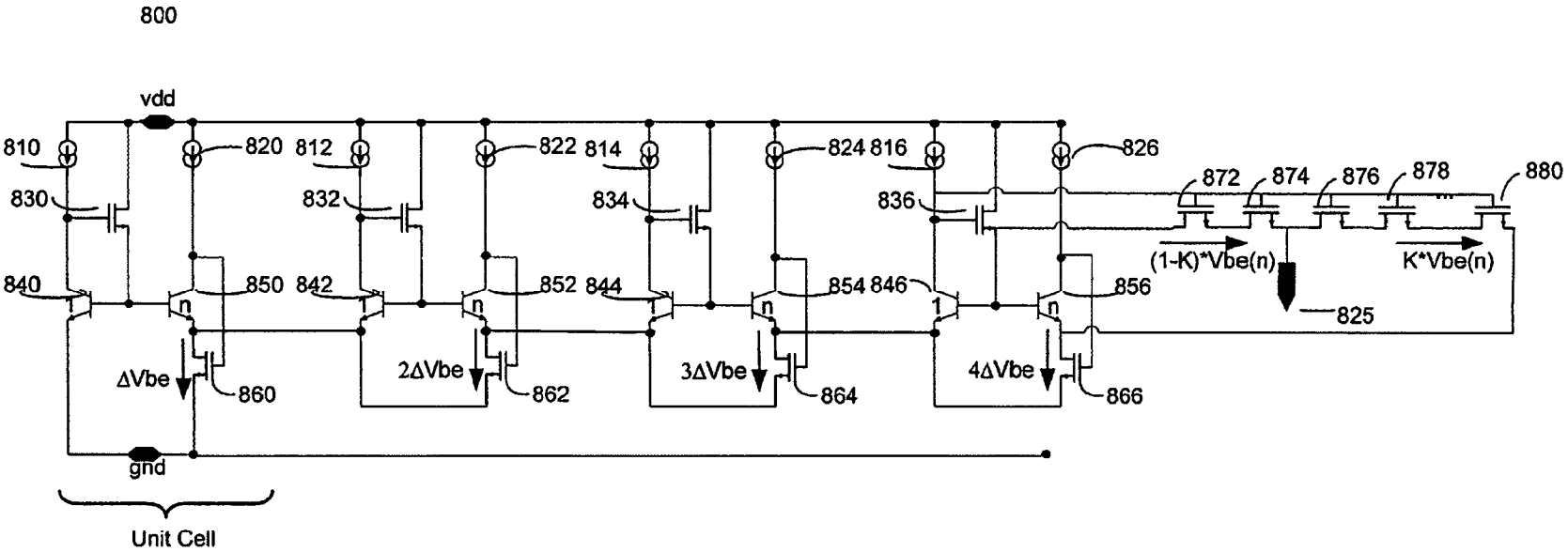
FIG. 8 shows an embodiment of a reference voltage based on a cascading PTAT voltage plus a fraction of the base-emitter voltage.

FIG. 8 shows a reference voltage circuit with a cascading PTAT configuration which generates a large PTAT, wherein the PTAT output is divided by a series of resistances, in accordance with an embodiment of the present invention. In one embodiment the base-emitter voltage of the last transistor from the chain (i.e., bipolar transistor 856) is divided via NMOS transistors 872, 874, 876, 878, and 880, such that a temperature independent voltage is generated. Circuit 800 of FIG. 8 is configured substantially similar to the cascade circuit 500 of FIG. 5 but includes a series of resistances substantially similar to the third set of circuit elements of circuit 600. Accordingly, the principles and benefits of a cascade configuration as well as the fractional division of the CTAT voltage discussed in the context of circuits 500 and 600 respectively, are applicable to circuit 800 as well. In the example of FIG. 8, a chain of four unit cells (each substantially consistent with circuit 300) may be used to generate a voltage which is four times the PTAT voltage of the unit cell. In one stage (i.e., the last) the a series of resistances 872, 874, 876, 878, and 880, divide the base-emitter voltage of bipolar transistor 856, as discussed in the context of FIG. 6, providing a fine-tuned temperature independent voltage reference at output 825.

Figure 9:
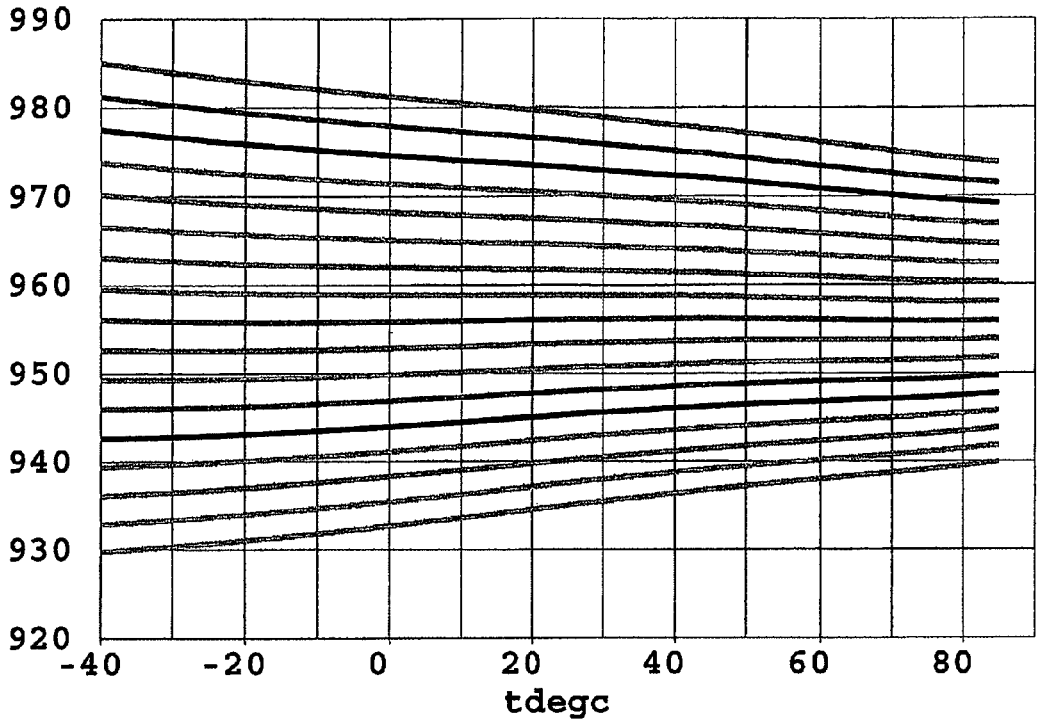
FIG. 9 shows simulation results of different voltage values for different input codes in accordance with FIG. 7.

FIG. 9 shows simulation results of voltage reference circuit at different nodes of a resistive divider of a circuit including the digital trimming concepts of circuit 700 in accordance with an embodiment of the present invention. In this exemplary embodiment, the PTAT voltage is based on five unit cells. The supply current of the circuit is only 50 nA, including 10 nA output current (similar to output 695 of FIG. 6). As further regards the exemplary embodiment, the total supply current of the reference voltage output (similar to output 825 of FIG. 8) is approximately 150 nA. FIG. 9 shows different reference voltage plots selected at different emitter outputs, representing different output voltages vs. temperature in relation to different input codes. For example, the curves may represent the voltage over temperature at the emitter nodes of NMOSs 872 to 880 of FIG. 8. As FIG. 9 illustrates, different voltage slopes can be selected, the resolution depending on the number of transistors in the base-emitter voltage divider (i.e., resistances 872 to 880 of FIG. 8). In one embodiment, this tuning can be done via metal options. In another embodiment electrical or laser fuses may be used. In yet another embodiment, the tuning can be done digitally by activating appropriate MOS gates to select the desired output.

Figure 10:
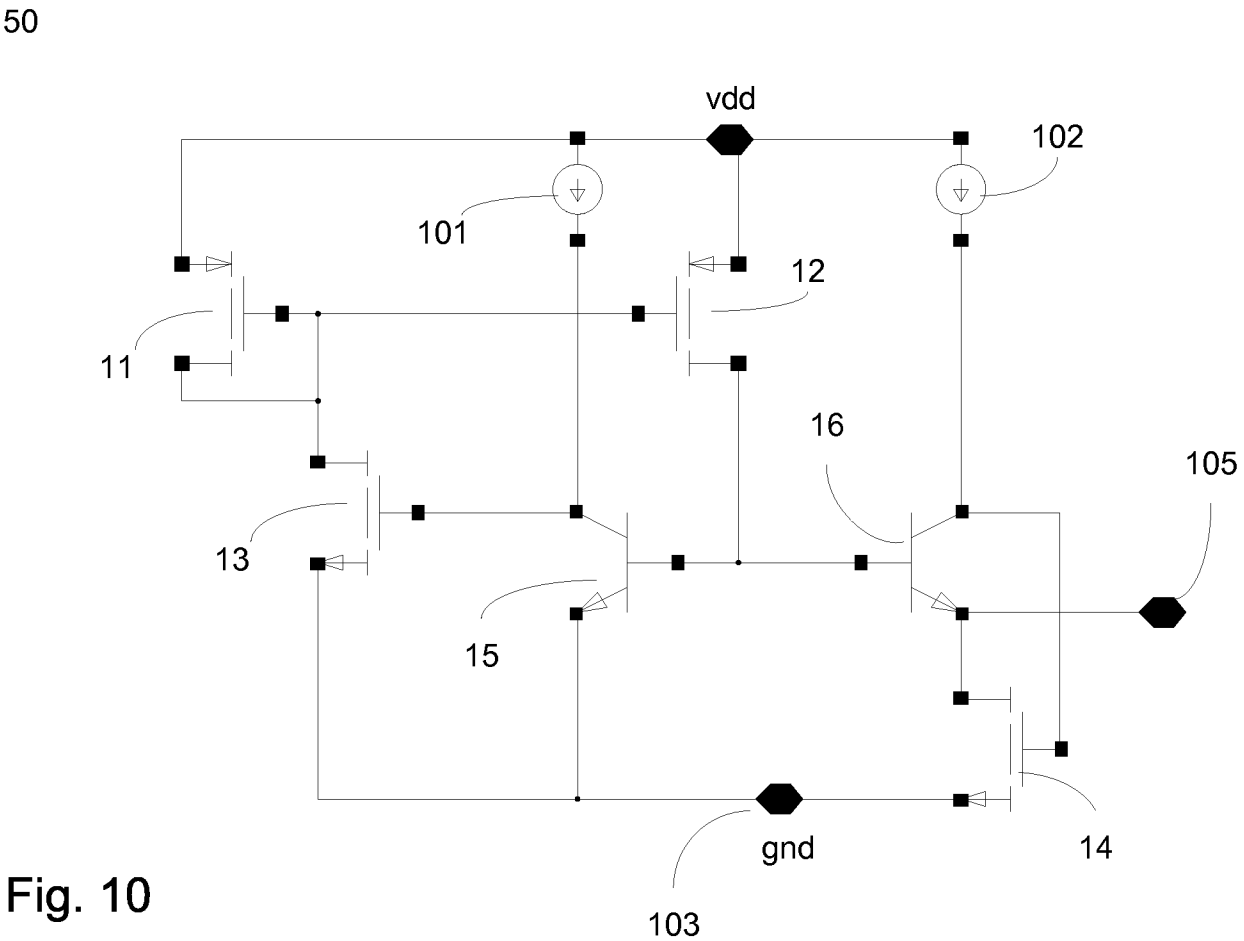
FIG. 10 shows a base-emitter voltage difference circuit in accordance with an embodiment of the present invention.

FIG. 10 shows an embodiment of base-emitter voltage difference circuit 50 which is analogous to the unit cell of FIG. 3*a* and includes PMOS transistors 11 and 12, NMOS transistors 13 and 14, bipolar transistors 15 and 16, and current sources 101 and 102. Compared to FIG. 3*a*, the current sources 101 and 102 are analogous to the current sources 310 and 320, the bipolar transistors 15 and 16 are analogous to the bipolar transistors 340 and 350, and the NMOS transistors 14 is analogous to the transistor 360. A PTAT voltage is generated as a difference between the base-emitter voltages of the bipolar transistors 15 and 16. The circuit 50 differs from the circuit in FIG. 3*a* in that the NMOS transistor 330 has been replaced with a set of transistors 11, 12 and 13 to provide a different biasing scheme for the bipolar transistors 15 and 16.

The circuit of FIG. 10 is adapted to generate a low band noise, low headroom voltage difference between the nodes 105 and 103 (this is the PTAT voltage generated as a difference between the base-emitter voltages of the bipolar transistors 15 and 16) based on the collector current densities of transistors 15 and 16. As it is known, the low band noise voltage (usually measured in the 0.1 Hz to 10 Hz band) of bipolar transistors and circuits based on bipolar transistors is dominated by the bipolar base currents. This noise increases as the "beta" factor (dc collector to base current ratio) decreases. The low band noise improvement results from the fact that, unlike the circuit of FIG. 3*a*, the base currents for transistors 15 and 16 are not subtracted from the current source 101 (310 in FIG. 3*a*) which is injected into the collector of transistor 15. NMOS transistor 13 controls the collector voltage of bipolar transistor 15 and generates the base currents for bipolar transistors 15 and 16 via a current mirror formed by PMOS transistors 11 and 12. The control and base current generation occur due to the connection between the gate of NMOS transistor 13 and the collector of bipolar transistor 15. Any change in the collector to ground voltage of the collector of bipolar transistor 15 is translated via a feedback loop formed by NMOS transistor and the current mirror (PMOS transistors 11 and 12). For example, if the collector voltage of transistor 15 increases, the corresponding increase in gate voltage at the NMOS transistor 13 will generate more current into the drain of NMOS transistor 13. This additional current is mirrored from PMOS transistor 11 to PMOS transistor 12 and returned to the common base of bipolar transistors 15 and 16, thereby maintaining the collector voltage of bipolar transistor 15 at approximately the same level. Each transistor 11/12 forms a separate branch of the current mirror, with the transistor 12 providing the base current for the bipolar transistors 15 and 16.

The low headroom property results from the way the two base currents (of transistors 15 and 16) are generated when NMOS transistors 13 and 14 are controlling the collector to ground voltage of their respective bipolar transistors 15 and 16. If NMOS transistors 13 and 14 are medium or low threshold NMOS devices, the collector potentials of bipolar transistors 15 and 16 can go below the common base potential, at least at cold temperatures where the circuit is able to limit the headroom. This arrangement also reduces the Early effect as NMOS transistors 13 and 14 can be scaled to track each other in order to minimize the base-collector voltage difference for bipolar transistors 15 and 16. Reduction of the Early effect occurs because the collector current of bipolar transistor 16 is controlled in a similar manner to the collector current of bipolar transistor 15, using a separate feedback loop formed by bipolar transistor 16 and NMOS transistor 14. NMOS transistors 13 and 14 both have their sources connected to ground, and each has their gate respectively connected to the collectors of bipolar transistors 15 and 16. Therefore, the collector voltages of bipolar transistors 15 and 16 are respectively determined by the gate-source voltages of NMOS transistors 13 and 14 and if NMOS transistors 13 and 14 are appropriately scaled, the collector voltages of bipolar transistors 15 and 16 will track each other, thereby minimizing the Early effect. The current mirrors 11 and 12 may alternatively be formed using bipolar transistors (e.g., pnp transistors).

Figure 11:
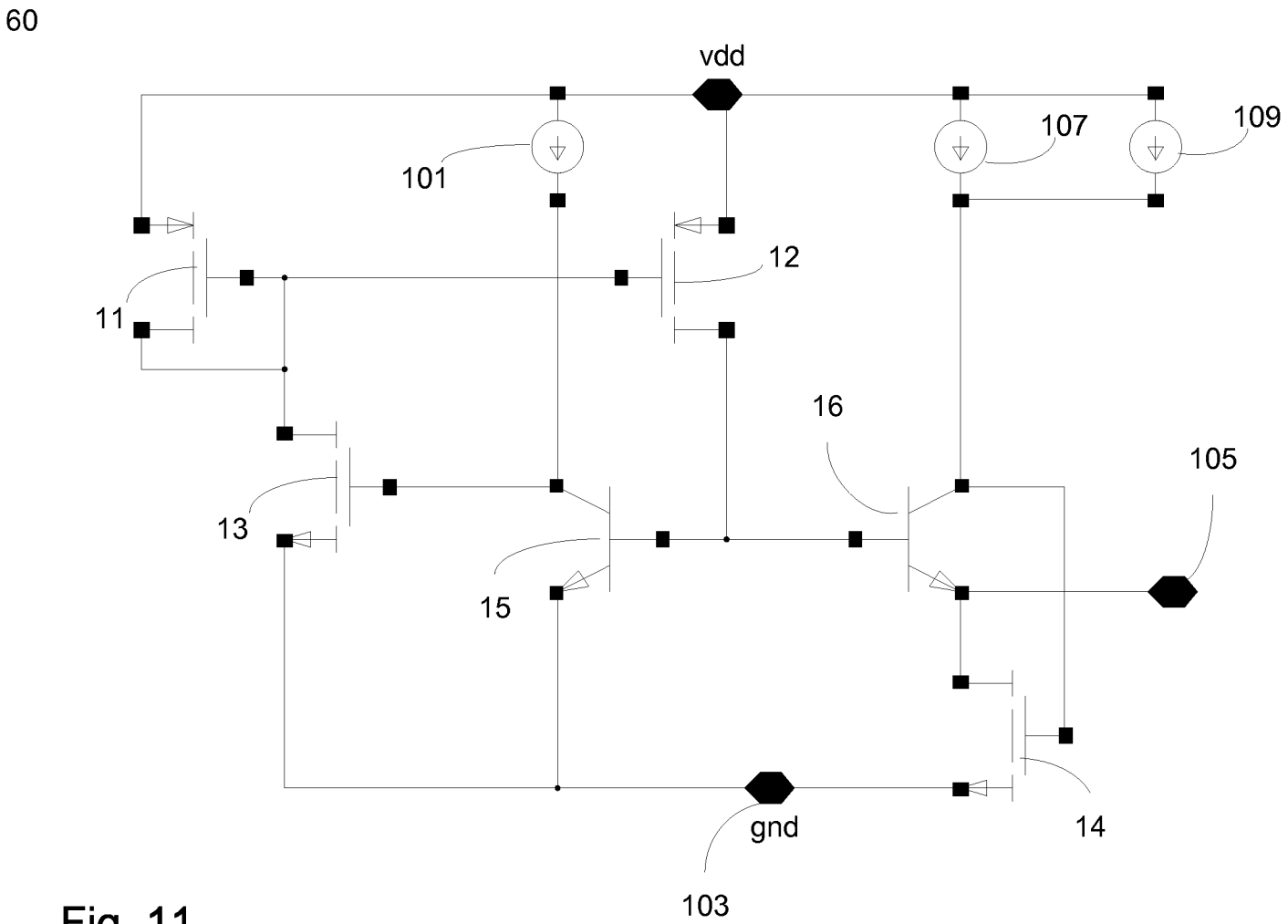
FIG. 11 shows a base-emitter voltage difference circuit in accordance with another embodiment of the present invention.

FIG. 11 shows a modification of the circuit in FIG. 10 that incorporates non-linear correction to form a high precision bandgap type voltage reference. As shown, a base-emitter voltage difference circuit 60 includes the PMOS transistors 11 and 12, NMOS transistors 13 and 14, bipolar transistors 15 and 16, and current source 101. A pair of current sources 107 and 109 have been added and replace the current source 102. Current source 107 is PTAT and current source 109 is CTAT. The circuit of FIG. 11 compensates for 2nd order error (non-linearities) that exist when attempting to balance CTAT voltage with PTAT voltage. Through appropriate biasing of the bipolar transistors 15 and 16 using the current sources 107 and 109, a base-emitter voltage difference $\Delta Vbe$ is generated (across nodes 105 and 103) with a curvature opposite to that of the base-emitter voltage Vbe at the output of the circuit (the emitter of bipolar transistor 16).

If the collector currents of bipolar transistors 15 and 16 in FIG. 11 have the same TC, the voltage difference between the nodes 105 and 103 has very little non-linearity. In a bandgap type voltage reference circuit, this voltage difference or a gained replica of it is to added to a base-emitter voltage Vbe of a bipolar transistor (balancing PTAT and CTAT voltages). If the base-emitter voltage Vbe is non-linear (as shown in Equation 3 below), then the voltage difference between the nodes 105 and 103 will not properly balance the base-emitter voltage Vbe, which is related to absolute temperature (T) according to Eq. 3:

$$V_{be}(T) = V_{G0} - [V_{G0} - V_{be}(T_0)] * \frac{T}{T_0} - \gamma * \frac{kT}{q} * \ln\left(\frac{T}{T_0}\right) + \frac{kT}{q} * \ln\left(\frac{I_c(T)}{I_c(T_0)}\right) \quad \text{(Eq. 3)}$$

$V_{G0}$ is the extrapolated bandgap voltage value; $V_{be}(T_0)$ is the base-emitter voltage value at a reference temperature $T_0$; $\gamma$ is the temperature exponent of the saturation current; k is Boltzmann's constant; q is electron charge; $I_c(T)$ is the collector current value at temperature T and $I_C(T_0)$ is the collector current value at temperature $T_0$. The first two terms of Eq. 3 have a linear relationship with absolute temperature, T. This dependence can be compensated with a linear base-emitter voltage difference, which the circuit of FIG. 10 is capable of providing. However, the last two terms of Eq. 3 have non-linear relationships with T that are not addressed by the circuit in FIG. 10. If the collector currents of the bipolar transistors 15 and 16 are PTAT currents, then Eq. 3 becomes:

$$V_{be}(T) = V_{G0} - [V_{G0} - V_{be}(T_0)] * \frac{T}{T_0} - (\gamma - 1) * \frac{kT}{q} * \ln\left(\frac{T}{T_0}\right) \quad \text{(Eq. 4)}$$

In order to compensate for Vbe in Eq. 4, an opposite voltage that is non-linear is added by the circuit of FIG. 11. This non-linear voltage can be provided by the base-emitter voltage difference generated in the circuit of FIG. 10 by modifying the circuit according to FIG. 11, where the current sources 101, 107 and 109 cause the collector currents of bipolar transistors 15 and 16 to have different TC. The collector current of bipolar transistor 15 in FIG. 11 is PTAT (as was the case in FIG. 10), whereas the collector current of bipolar transistor 16 can be made temperature independent by mixing the two currents 107 and 109. The voltage difference between the nodes 105 and 103, i.e., the base-emitter voltage difference of the circuit of FIG. 11 is then provided by Equation 5 below:

$$\Delta V_{be} = \frac{kT}{q} * \ln\left(\frac{I_{c1}(T_0) * \frac{T}{T_0}}{I_{c2}(T_0)} * n\right) = \frac{kT}{q} * \ln\left[n * \frac{I_{c1}(T_0)}{I_{c2}(T_0)}\right] + \frac{kT}{q} * \ln\left(\frac{T}{T_0}\right) \quad \text{(Eq. 5)}$$

$I_{C1}(T_0)$, and $I_{C2}(T_0)$ are the respective collector current values of bipolar transistors 15 and 16 at temperature $T_0$. The first term of Eq. 5 is designed to compensate for the linear component of the base-emitter voltage in Eq. 4. The last term of Eq. 5 is accordingly scaled and designed to compensate for the non-linear voltage component of Eq. 4. Therefore, by mixing PTAT and CTAT currents (provided by the current sources 107 and 109) the collector current of bipolar transistor 16 can have a different TC, that is neither PTAT nor constant. As a result, the non-linear voltage component of Eq. 5 can be shaped to adapt for process variations in the factor $\gamma$.

Figure 12:
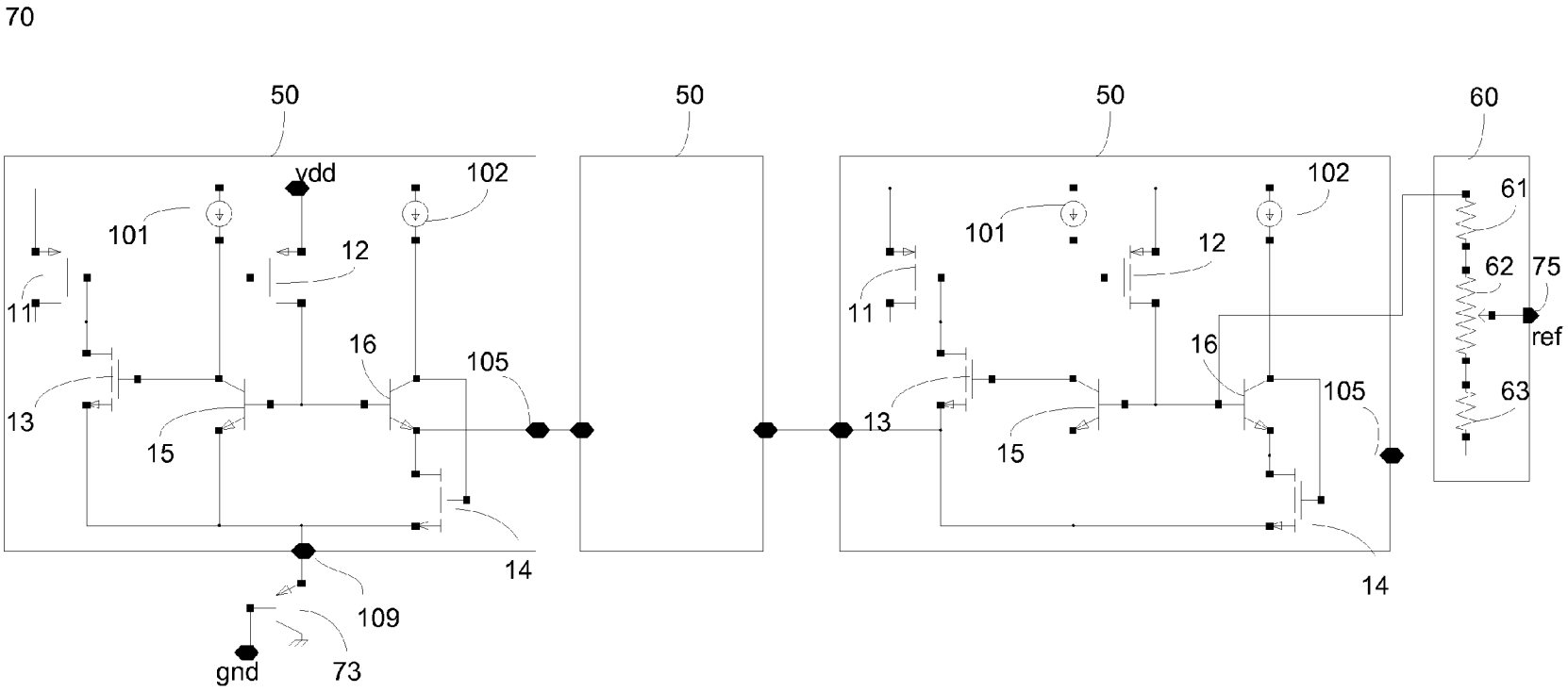
FIG. 12 shows a voltage cascading circuit in accordance with another embodiment of the present invention.

The base-emitter voltage difference circuits 50 and 60 in FIGS. 10 and 11 can be cascaded in a similar fashion to FIG. 5. For example, in FIG. 12 the base-emitter voltage difference circuit 50 forms a unit cell in a cascading circuit 70 having "n" number of cells (in FIG. 12, n=3). The cascaded arrangement generates a compound PTAT voltage that is larger than the PTAT voltage generated by any individual cell by the factor n.

Optionally, instead of connecting the common node 103 directly to ground, the common node 103 of the first cell 50 may be connected to ground through the emitter of a bipolar transistor 73 that has its collector and base connected to ground. The emitter current of bipolar transistor 73 collects all currents from each of the "n" cells and averages all the collected currents. This is an improvement over the cascading circuit of FIG. 5, where all currents are collected except the current 510 (starting at the rightmost cell, transistor 566 collects current 526, transistor 564 collects 524, 516 and 526, transistor 562 collects 522, 514, 524, 516 and 526, etc.). This has two advantages. First, the emitter current of bipolar transistor 73 has reduced variation due to the averaging of the bias currents in all cells. Second, a larger collector current for bipolar transistor 73 means less voltage noise is generated.

The cascading circuit 70 includes an optional resistor divider 60 formed using resistors 61 and 63 and a resistor string digital-to-analog converter (DAC) 62 that functions similar to an analog potentiometer to provide a variable resistance. The resistor divider 60 is connected between the base and emitter of the transistor 16 of the last unit cell to tap a selected fraction of the base-emitter voltage of transistor 16. In this arrangement, the base-emitter voltage of transistor 73 plus the corresponding fraction of the base-emitter voltage of transistor 16 at the last cell corresponds to the CTAT voltage component of the voltage reference collected at the tapping node "ref" 75. The PTAT voltage component of the voltage reference corresponds to the voltage between the node 105 of the last unit cell and new common node 109 of the first unit cell, i.e., a compound base-emitter voltage difference generated as a result of cascading the unit cells. The voltage reference, which is the sum of the PTAT and the CTAT voltage components, is therefore equal to the base-emitter voltage of transistor 73 plus the fraction of the base-emitter voltage tapped by the resistor divider, and plus the compound base-emitter voltage generated by the cascaded unit cells.

Figure 13:
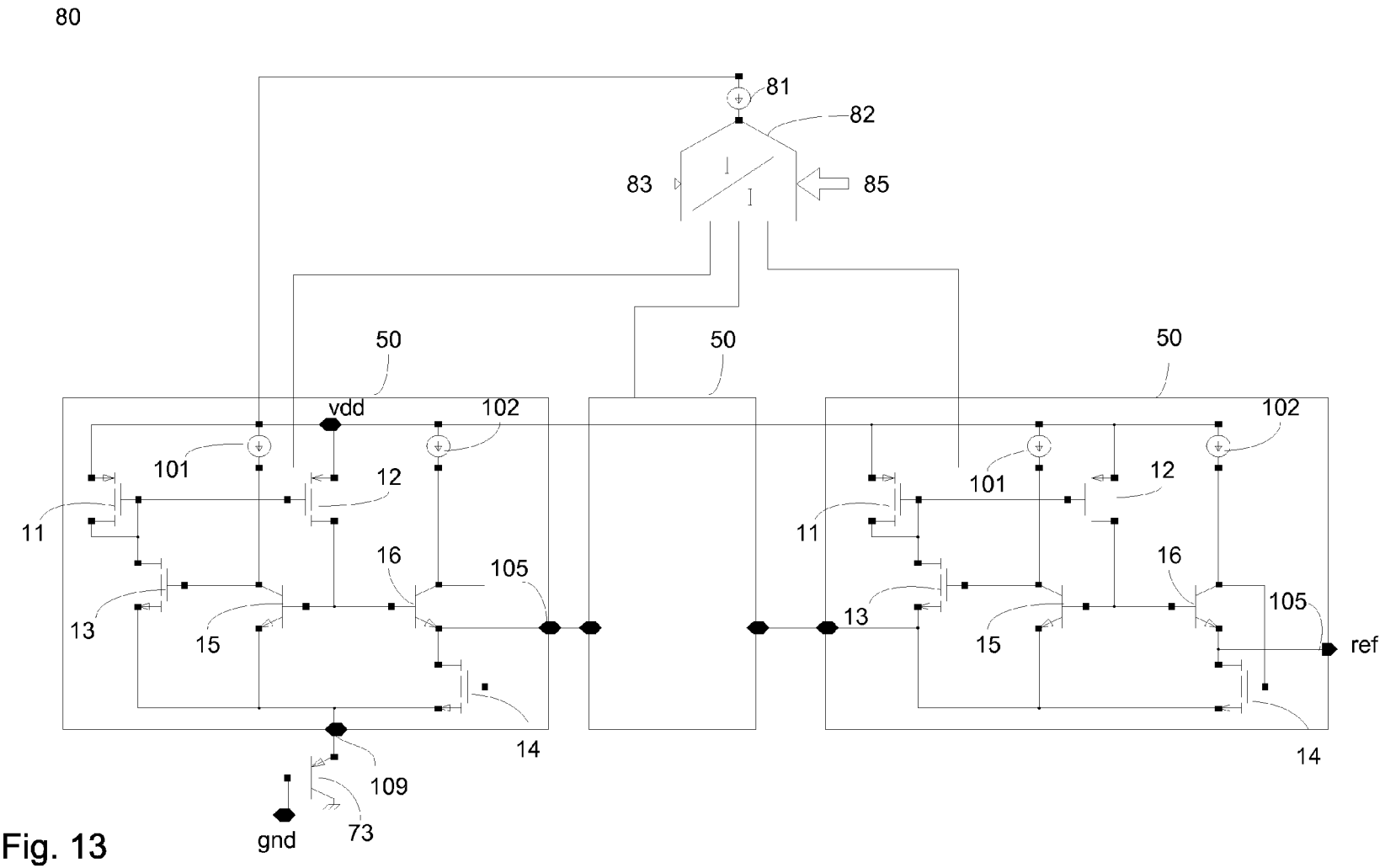
FIG. 13 shows a digitally controlled voltage reference circuit in accordance with an embodiment of the present invention.

FIG. 13 shows a digitally controlled voltage reference circuit 80 having cascaded cells. The basic idea of this circuit is to adjust one bias current 101 in each PTAT cell via a current to current trim DAC 82, which provides a separate current output to each PTAT cell. The input current of the DAC 82 and the collector currents of the transistor 15 in each cell are assumed to have the same TC, preferably PTAT. The digital input 85 of the DAC 82 controls in a thermometric fashion the outputs of the DAC 82. A control bit 83 selects the sign of the output currents of the DAC 82 such that the DAC output currents can be added to or subtracted from the collector currents of the bipolar transistors 15 in each of the PTAT cells. If there are eight PTAT cells with control bit 83=0 or 1, the PTAT voltage component of the reference can be trimmed using a maximum of sixteen equal steps. A finer trimming can be implemented if each DAC output is individually trimmed using a sub-DAC. Using the DAC 82, currents can be individually injected into or subtract from each cell to adjust the base-emitter voltage difference ΔVbe in each cell (i.e., the voltage at node 105 of each cell) such that each ΔVbe can be increased or decreased to compensate for variations in circuit parameters. This trimming may be performed, for example, when the circuit of FIG. 13 is initially manufactured in order to conform the circuit to design specifications.

Those skilled in the art will readily understand that the concepts described above can be applied with different devices and configurations. Although the present invention has been described with reference to particular examples and embodiments, it is understood that the present invention is not limited to those examples and embodiments. The present invention as claimed, therefore, includes variations from the specific examples and embodiments described herein, as will be apparent to one of skill in the art. For example, bipolar transistors can be used instead of MOS transistors. Further, PNP's may be used instead of NPN's, and PMOSs may be used instead of NMOSs. Accordingly, it is intended that the invention be limited only in terms of the appended claims.

What is claimed is:

1. A base-emitter voltage difference circuit, comprising:

a first bipolar transistor and a second bipolar transistor sharing a common base; and a third transistor connected between an emitter of the first bipolar transistor and an emitter of the second bipolar transistor, the third transistor also being connected in a feedback loop to a collector of the second bipolar transistor to generate a proportional to absolute temperature (PTAT) voltage as a difference between a base-emitter voltage of the first bipolar transistor and a base-emitter voltage of the second bipolar transistor, wherein the PTAT voltage is generated across the third transistor.

2. The circuit of claim 1, further comprising:

a fourth transistor that controls a collector voltage of the first bipolar transistor; and a current mirror connected to the fourth transistor, a first branch of the current mirror generating a current controlled by the fourth transistor, and a second branch of the current mirror providing a base current for the first and the second bipolar transistors.

3. The circuit of claim 1, further comprising:

a fourth transistor that controls a collector voltage of the first bipolar transistor, wherein the gate of the fourth transistor is connected to the collector of the first bipolar transistor.

4. The circuit of claim 1, further comprising:

a first current source supplying current to the first bipolar transistor;

a second current source supplying current to the second bipolar transistor; and a third current source supplying a third current that is mixed with the current supplied by the second current source.

5. The circuit of claim 4, wherein the second current source is PTAT and the third current source is complementary to absolute temperature (CTAT).

6. The circuit of claim 1, wherein the third transistor is directly connected to the emitter of the first bipolar transistor and directly connected to the emitter of the second bipolar transistor.

7. The circuit of claim 1, further comprising:

a fourth transistor that controls a collector voltage of the first bipolar transistor, wherein the fourth transistor is a component of a first amplifier that produces a base current of the first bipolar transistor and the second bipolar transistor.

8. The circuit of claim 7, further comprising:

a second current source supplying current to the second bipolar transistor, wherein the second current source, the second bipolar transistor and the third transistor form a second amplifier that generates the base-emitter voltage difference across the third transistor.

9. The circuit of claim 8, wherein the collectors of the first bipolar transistor and the second bipolar transistor are inputs of the first amplifier and the second amplifier, respectively.

10. The circuit of claim 7, wherein the first amplifier includes a fifth transistor connected to the bases of the first bipolar transistor and the second bipolar transistor, and wherein a gate of the fifth transistor is driven by the fourth transistor.

11. The circuit of claim 1, wherein the third transistor is one of a bipolar transistor and a MOS transistor, and generates the PTAT voltage in accordance with a collector current density ratio of the first bipolar transistor and the second bipolar transistor.

12. A cascading circuit, comprising:

a plurality of unit cells connected in a cascaded fashion, each unit cell comprising:

a first bipolar transistor and a second bipolar transistor sharing a common base; and a third transistor connected between an emitter of the first bipolar transistor and an emitter of the second bipolar transistor, the third transistor also being connected in a feedback loop to a collector of the second bipolar transistor to generate a proportional to absolute temperature (PTAT) voltage as a difference between a base-emitter voltage of the first bipolar transistor and a base-emitter voltage of the second bipolar transistor.

13. The circuit of claim 12, further comprising:

at the first unit cell of the cascading circuit, a third bipolar transistor forming a connection from ground to a common node that is connected to the first bipolar transistor and the third transistor.

14. The circuit of claim 13, wherein the base and collector of the third bipolar transistor are connected to ground and the emitter of the third bipolar transistor is connected to the common node.

15. The circuit of claim 12, further comprising:

a resistor divider generating a voltage reference by tapping a fraction of a base-emitter voltage of the second bipolar transistor in the last unit cell.

16. The circuit of claim 15, wherein the output of the last unit cell is generated as a combination of a base-emitter voltage of a third bipolar transistor plus the fraction of the base-emitter voltage tapped by the resistor divider, and plus a compound base-emitter voltage difference generated by the cascaded the unit cells, wherein the third bipolar transistor forms, at the first unit cell of the cascading circuit, a connection from ground to a common node that is connected to the first bipolar transistor and the third transistor.

17. The circuit of claim 15, wherein the resistor divider includes a resistor string digital-to-analog converter (DAC).

18. The circuit of claim 12, further comprising:

a first current source in each unit cell, the first current source supplying current to the first bipolar transistor in the unit cell; and a digital-to-analog converter (DAC) providing a plurality of output currents, each output current being combined with the first current source in a respective one of the unit cells.

19. The circuit of claim 18, wherein a first input of the DAC is a digital code that controls the output currents of the DAC in a thermometric fashion.

20. The circuit of claim 18, wherein a second input of the DAC is a control bit that selects a sign of the output currents of the DAC.

21. The circuit of claim 12, wherein the PTAT voltage is generated across the third transistor.

22. The circuit of claim 21, wherein the third transistor is one of a bipolar transistor and a MOS transistor, and generates the PTAT voltage in accordance with a collector current density ratio of the first bipolar transistor and the second bipolar transistor.

23. The circuit of claim 12, further comprising:

a fourth transistor that controls a collector voltage of the first bipolar transistor.

24. A method, comprising:

generating a proportional to absolute temperature (PTAT) voltage using a circuit in which a first bipolar transistor and a second bipolar transistor share a common base, wherein the PTAT voltage is generated across a third transistor connected between an emitter of the first bipolar transistor and an emitter of the second bipolar transistor, the third transistor also being connected in a feedback loop to a collector of the second bipolar transistor to generate the PTAT voltage as a difference between a base-emitter voltage of the first bipolar transistor and a base-emitter voltage of the second bipolar transistor;

generating a complementary to absolute temperature (CTAT) voltage using the circuit; and using a signal that combines the PTAT voltage and the CTAT voltage as a voltage reference.

* * * * *